United States Patent [19]

Guillot

[11] 4,157,006

[45] Jun. 5, 1979

[54] DEVICE FOR TWISTING YARNS WHICH ARE WOUND UNDER CAKE PACKAGE FORM

[75] Inventor: Felix Guillot, Roanne, France

[73] Assignee: ASA S.A., Roanne, France

[21] Appl. No.: 881,990

[22] Filed: Feb. 28, 1978

[51] Int. Cl.[2] ..... D01H 7/00

[52] U.S. Cl. ..... 57/59; 57/129; 242/46.2; 242/128

[58] Field of Search ..... 57/59, 60, 62, 129, 57/130; 242/130, 130.1, 118, 128, 118.1, 46.2, 46.21, 46.3, 46.6, 46.7, 46.4

[56] References Cited

U.S. PATENT DOCUMENTS

| | | | |
|---|---|---|---|
| 1,898,115 | 2/1933 | Aldrich | 242/46.2 |
| 1,898,131 | 2/1933 | Jordan | 242/46.2 |
| 2,406,768 | 9/1946 | Hitt | 242/46.2 |
| 2,577,571 | 12/1951 | Ewing | 57/59 |
| 2,649,683 | 8/1953 | Henry | 57/59 |
| 3,167,262 | 1/1965 | Adams et al. | 57/130 X |
| 3,284,024 | 11/1966 | Franzen | 242/128 |
| 3,693,338 | 9/1972 | Cunningham et al. | 242/46.2 X |
| 3,972,489 | 8/1976 | Kovaleski | 242/128 |
| 4,039,159 | 8/1977 | Champagne | 242/130.1 |

FOREIGN PATENT DOCUMENTS

| | | |
|---|---|---|
| 751626 | 6/1933 | France. |
| 1539707 | 8/1968 | France. |

*Primary Examiner*—John Petrakes

*Attorney, Agent, or Firm*—Arnold, White & Durkee

[57] ABSTRACT

The invention concerns a device for up-twisting directly a spinning package having the shape of the cake. According to the invention, the device comprises a vertical spindle driven in rotation at constant or variable speed. Centering and positioning means are provided for the cake on the spindle, said means preferably comprising two cones placed in opposition and fitted at each extremity of the cake. The cones are characterized by the lower cone being secured to the spindle axle and the package being positioned between the two cones by means of a locking element which connects the lower cone to the upper cone. Preferably, the upper cone is associated with a cap flyer which projects beyond the outer edge of the package. The invention applies itself particularly well to up-twisting.

5 Claims, 1 Drawing Figure

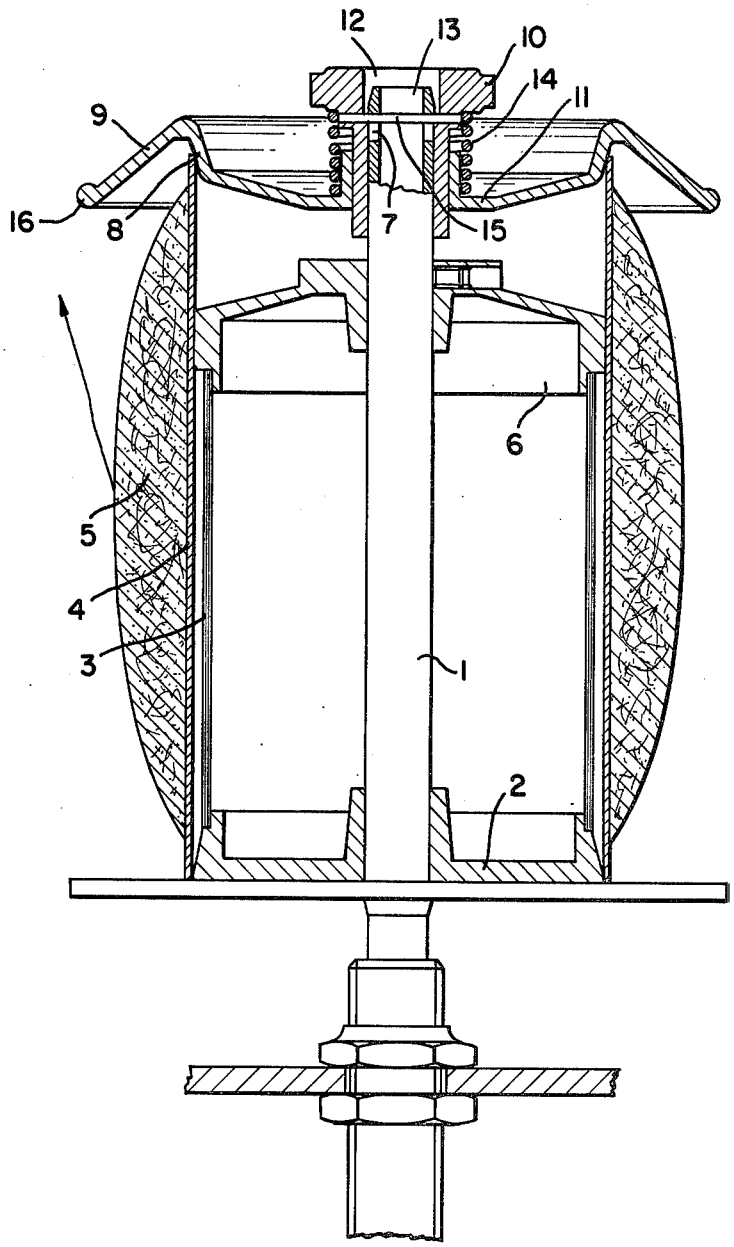
12
13
10
14
11
9
16
8
7
15
6
5
4
3
1
2

DEVICE FOR TWISTING YARNS WHICH ARE WOUND UNDER CAKE PACKAGE FORM

The present invention concerns an improved device allowing direct uptwisting operations, which may be associated with a down-twisting or cabling operation, of a yarn stocked under the form of a cross-wound package without flanges, for example a cake or bobbin.

During the production of chemical yarns and mainly glass or rayon yarns, generally the material is taken up under the form of a large diameter wound package on a cheap tube, typically made of cardboard or thin plastic, whose diameter may be between one hundred to three hundred millimeters to allow winding at high-speed.

In the description which follows, the invention will be described as applied to glass yarns taken-up under the form of cakes during their spinning, but it is evident that this is not a limitation and that it can be also utilized with other materials (yarns) and other cross-wound packages without flanges.

It is well known that the production of glass yarns (silionne) includes extruding melted glass through spinnerets with the filaments, originating from the spinneret, being drawn at high speed due to the traction exerted by the Spindle. At the spinneret exit the filaments receive a spin finish and are wound without twist on a cardboard support.

Generally, the diameter of the take-up support is as mentioned previously, between one hundred and three hundred millimeters, the most commonly utilized diameters being between one hundred and sixty and two hundred millimeters and the take-up speed reaching between two thousand five hundred to four thousand meters/minute or even more. The take-up packages have a weight which can vary from two hundred and fifty grams to eight kilograms, or in some cases even more than ten kilograms of product. The thickness of the yarn on the support tube is low and generally situated between two and five centimeters.

It is desirable, on one hand, to increase the output speeds and, on the other hand, to increase the package weights.

It is well known that before ultimate utilization, in most cases yarns without twist must receive a certain protecting twist. The twist is variable according to the application and its aim is to give cohesion to the filaments, arranged in a helix form, to improve the resistance to friction and, to a certain extent, the resistance to traction. This twist is imparted to the yarn during an up-twisting and/or a down-twisting operation.

Generally "up-twisting" refers to an operation of communicating twist to the yarn at the moment of the package unwinding operation, the yarn then being taken-up on another package. "Downtwisting", refers to an operation of communicating twist to the yarn during its take-up operation. In certain cases, it is possible to combine the up-twisting operation with the downtwisting operation. The invention is particularly suitable for machines permitting continuous up-twisting and down-twisting.

To this day, it has been impossible to realize, at least at industrial speeds, up-twisting and/or down-twisting operations originating from a cake. As a matter or fact, cakes are non-rigid packages which have a tendency to get out of shape, which leads to problems when attempting to drive them into a rotational movement. Furthermore, because of the spin finish, the yarn spires have a tendency to stick together and, as a result, are difficult to unwind regularly during the unwinding operation as realized generally during an up-twisting operation.

Consequently, it is therefore proposed, before up-twisting and/or down-twisting, to transfer the yarn from the cake to a conventional support which may be utilized on an up-twister and/or down-twister. This preparatory operation is accomplished by an unrolling operation of the yarn from the cake. By driving positively and eventually at variable speed, the cake rotational motion may result in a yarn driven at constant linear speed. The traveller tension which runs through to the cake allows easy clearing of the yarn spires from one another.

Therefore, an object of the present invention is to provide a new device which permits the elimination of the yarn transfer between cake and bobbin on an intermediary twisting machine and which results in the possibility of directly using the cakes on up-twisting or combined up-twisting and cabling machines. This leads to the elimination of an intermediary operation and results in the evident advantages of improvement of the produced yarn quality and the reduction of the total transformation costs.

The device of the invention is particularly well suited to up-twisting/down-twisting or up-twisting cabling machines, but it is evident that this is not a limitation.

According to the invention, the device for nose unwinding the yarn from a spinning cake comprises:

(a) a vertical spindle 1 driven in rotation at constant or variable speed, (b) cake centering and positioning means on the aforesaid spindle, the means comprising two cones 2 and 8 placed in opposition and fitted at each end of a cardboard take-up tube 4 supporting the wound yarn 5, (c) means for locking both cones characterized by the fact that:

(i) the lower cone 2 is fixedly secured to the spindle 1 and is extended by an auxiliary circular centering element 6, of smaller diameter than the cake inside diameter, (ii) the cake positioning between the two cones 2 and 8 being obtained by means of a locking element 3 which connects the lower cone 2 to the upper cone 8. The locking element 3 is associated with a cap flyer 9 whose diameter is larger than the outer diameter of the package, thereby facilitating yarn clearing during the unwinding operation and favoring balloon forming.

The cap flyer associated with the upper cone is either immobilized against the cone surface, for example, by a locking element, or forms a single solid element with the upper cone.

Furthermore, in a preferred embodiment, one of the cones, preferably the lower cone, is advantageously associated to an auxiliary guiding and centering element, of circular form, whose diameter is smaller than the inside diameter of the package and shorter than the package length, the aforesaid guiding part being fitted with connecting elements to the locking element.

The cake is pressed by the pressure between both cones with its diameter in the center reduced slightly so to apply itself against the auxiliary guiding and centering element which maintains it perfectly in the spindle axis.

In this manner, during rotation, the cake is perfectly held, on one hand, by the cones located at its extremities and, on the other hand, in its center part, by the auxiliary guiding and centering element, which drives it at high rotational speeds without excessive vibrations.

Furthermore, the presence of the cap flyer in the neighborhood of the upper cone facilitates yarn spire nose unwinding operations.

According to a preferred embodiment of the invention, the connecting and locking element which joins both cones and immobilizes the package between them may be a removable element which:

(1) lays on the upper cone,
(2) traverses the upper cone and penetrates into the internal cavity of the cake.
(3) fits on the spindle axis, and
(4) adapts itself on a complementary fixed part.

In one embodiment, the connecting and locking element is constituted by an element whose upper part lays on the upper cone, this element including a spring which has a tendency to separate it from the upper cone, the lower part of the element emerging into the cake cavity and sliding on the spindle axle and including at its extremity a bush which engages itself with junction means which are interdependant to the lower cone, such a system corresponding, for example, approximately to an electric bulb "Bayonet Socket".

The invention and its advantages will be better understood with reference to the example illustrated in the FIGURE which shows, in cross section view, an assembly constructed in accordance with the invention.

As can be seen with reference to the FIGURE, the locking and nose unwinding device of a yarn package having the shape of a cake according to the invention includes:

(a) a spindle 1 driven in rotation and fitted on a frame in a conventional manner, (b) a lower cone 2 secured to the spindle 1 and extended by a cylindrical part 3 of a smaller diameter than the inside diameter of the cardboard tube 4 that supports the yarn package 5. The cylindrical part 3 is connected at its top end to a ring 6 which is also secured to spindle 1. This ring, of course, also has a smaller diameter than the package inside diameter, and engages the inside of tube 4 to rotatably drive the package, (c) an upper cone 8 having a flange 9 which is larger than the yarn package (cake) 5 outer diameter and which plays the part of a cap flyer when nose unwinding the yarn in order to clear the yarn and encourage the formation of a balloon, and (d) centering and positioning means which is preferable a removable element which traverses the upper cone 8 and which includes:

(i) a center portion 11 of cone 8,
(ii) an element 10 having an internal cavity 12 which permits element 10 to be centered on the top 13 of spindle 1 and which facilitates the positioning, centering and driving of the cake,
(iii) a spring 14 placed between portion 11 and the upper part of element 10 to serve as a tightening element of the assembly, and
(iv) connecting means 15 with complementary connecting means 7 forming a Bayonet connection.

Advantageously, flange 9 which plays the part of a cap flyer during nose unwinding operations is shown in the FIGURE in the shape of a bell whose lower lip 16 extends to the cake outer part.

In the illustrated embodiment, the connecting elements 7 and 15 are of the "Bayonet" type which allows quick and efficient unfastening and fastening.

By using the apparatus of the invention it is possible to utilize, directly on an uptwister, cakes of three kilograms, of two hundred and twenty millimeters outer diameter and of two hundred and fifty millimeters length. This cake may be used at a spindle speed of five thousand revolutions per minute without provoking breakages and/or excessive over tensions. The yarn quality obtained, in particular the twist regularity over its length, is comparable to that obtained with a yarn twisted in the conventional manner, i.e., by unwinding of the cake on an intermediary support to supply the up-twister.

It had already been proposed to use centering and positioning means of the cake on the spindle with the assistance of cones (see in particular French Pat. Nos. 751,626 and 1,539,707 and U.S. Pat. No. 1,898,131). However, these solutions have not given satisfaction, primarily due to the fact that they utilize no centering element. The device of the invention is particularly adapted to silionne yarn up-twisting originating directly from the spinning area, i.e., under the shape of cakes without twist.

To this day cakes have been processed on a specially controlled unroll supply machine whose speed was limited to about one hundred and fifty meters/minute. On the other hand, with the application of the device of the invention on an arrangement involving in series:

(i) a rotating supply spindle on which is placed the cake originating from the spinning area,
(ii) a rotating take-up spindle, and
(iii) with continuous yarn passage between these two spindles with yarn path deviations, one can reach linear speeds of approximately three hundred meters/minute and even more, if one considers the fact that the supply spindle, working under the same principle as an up-twister, is not limited in speed by the fact that there is no ring or traveller.

While the present invention has been disclosed in connection with specific embodiments, it will be apparent to those skilled in the art that numerous modifications may be made without departing from the spirit or scope of the invention.

I claim:

1. In a device for direct up-twisting of a package having the form of a cake, said device being of the type including:

(a) a vertical spindle adapted for being rotatably driven at constant or variable speed; and
(b) cake centering and positioning means on said spindle including first and second opposed cones for engaging the ends of a take-up tube which supports the wound yarn;

an IMPROVEMENT in said cake centering and positioning means wherein said first cone is fixedly secured to the spindle, said cake centering and positioning means further including a circular centering element between said cones, means for securing said centering element to said first cone for rotation with the spindle, said centering element having a diameter only slightly smaller than the take-up tube for engaging and rotatably driving the tube, means for urging the cones toward each other to position the cake therebetween, and a cap flyer associated with the second cone and having a diameter larger than the outer diameter of the package to control yarn ballooning during the unwinding operation.

2. A device as claimed in claim 1 wherein said first cone is a lower cone and said second cone is an upper cone.

3. A device as claimed in claim 2 wherein said cap flyer is fixedly secured to the upper cone.

4. A device as claimed in claim 2 wherein said means for urging includes a removable locking element fitting on the spindle axis and laying upon the upper cone, said locking element traversing said upper cone and penetrating into the cake internal cavity.

5. A device as claimed in claim 4 wherein the connection between the locking element and the upper cone is of a Bayonet socket type tightenable by a spring.

* * * * *